United States Patent [19]

Smith et al.

[11] Patent Number: 4,955,626

[45] Date of Patent: Sep. 11, 1990

[54] SKATEBOARDS

[76] Inventors: Eric O. M. Smith; James Fisher; Simon King, all of P.O. Box 650228, Benmore, 2010, South Africa

[21] Appl. No.: 301,494

[22] Filed: Jan. 25, 1989

[30] Foreign Application Priority Data

Jan. 28, 1988 [ZA] South Africa ..... 88/0576

[51] Int. Cl.[5] ..... A63C 17/01

[52] U.S. Cl. ..... 280/87.042; 280/11.28; 280/87.041; 280/87.043

[58] Field of Search ..... 280/11.26, 14.2, 16, 280/17, 87.042, 87.043, 87.041, 11.27, 11.28

[56] References Cited

U.S. PATENT DOCUMENTS

| | | | |
|---|---|---|---|
| 2,474,946 | 7/1949 | Kinslow | 280/87.042 |
| 3,771,811 | 11/1973 | Bueno | 280/87.042 |
| 4,054,297 | 10/1977 | Solimine | 280/87.042 |
| 4,082,306 | 4/1978 | Sheldon | 280/87.042 |
| 4,202,559 | 5/1980 | Piazzo, Jr. | 280/87.042 |
| 4,221,394 | 9/1980 | Campbell | 280/14.2 |

*Primary Examiner*—Richard A. Bertsch
*Assistant Examiner*—Eric Culbreth
*Attorney, Agent, or Firm*—McGlew & Tuttle

[57] ABSTRACT

This invention relates to a skateboard which includes two footboards with each footboard consisting of a foot platform and a wheel-set which carries two wheels in axial alignment fixed to the underside of the platform, a spacer element for holding the footboards in a spaced relationship and a pivot arrangement having a vertical pivot axis connecting each footboard to the spacer element to enable both footboards to pivot relatively to the spacer element.

15 Claims, 3 Drawing Sheets

SKATEBOARDS

FIELD OF THE INVENTION

This invention relates to skateboards.

BACKGROUND OF THE INVENTION

Conventional skateboards consist of a substantially rigid board which carries two spaced wheel-sets or trucks which are fixed to its underside with the wheels of the wheel-sets lined on a common track. The wheels of each wheel-set, on the more elaborate boards, are very slightly steerable through an offset suspension system with the skater steering the board by shifting his feet on and his body position above the board so that the centre of gravity of his weight may be used to vary the adhesion of the wheels on a common wheel-set with the road surface.

U.S. Pat. Nos. 3,771,811 and 4,202,559 disclose boards in which one of the wheel-sets is fixed to the underside of the board while the other is attached to the underside of a rotatable platform at the other end of the board so that the platform and its wheel-set are steerable as a unit by a foot of the skater. The purpose of the steering platforms on both boards is, according to the specifications, to provide a board for children or novices which may easily be foot steered without positional shifting of the skaters body on the board.

OBJECT OF THE INVENTION

It is the object of this invention to provide a skateboard which is steerable and is highly maneuverable relatively to conventional boards.

SUMMARY OF THE INVENTION

A skateboard according to the invention includes two footboards with each footboard consisting of a foot platform and a wheel-set which carries two wheels in axial alignment fixed to the underside of the platform, a spacer element for holding the footboards in a spaced relationship and a pivot arrangement having a vertical pivot axis connecting each footboard to the spacer element to enable both footboards to pivot relatively to the spacer element.

Further according to the invention each wheel-set includes a resilient suspension member which is located in the wheel-set to enable limited resilient pivotal movement of the platform in a direction transverse to the direction of the axis of rotation of the wheels of the wheel-set.

In one form of the invention each wheel-set includes a wheel body, wheel axles which are fixed to and project from opposite sides of the body with the wheels being journalled for rotation on the axles, a first pivot pin which is attached to the wheel body with its axis in a vertical direction, a support member on the pivot pin, a second pivot pin pivotally connecting the foot platform to the support member with its pivot axis normal to the wheel axis, resilient suspension means between the support member and the underside of the foot platform for holding the platform horizontal and a pivot arrangement on the spacer element which is pivotally engaged with the first pivot pin between the wheel body and the support member. The wheel body and the support member of each wheel-set are advantageously integral to provide a wheel-set body with the support member pivot arrangements being engaged with the first pivot pins of each wheel-set through slots in the wheel-set bodies. The slots in the wheel-set bodies may have radially displaced vertical edges to stop rotation of the spacer element pivot arrangements on the first pivot pins to prevent the wheels from coming into contact with the spacer element.

Still further according to the invention the pivot arrangements on the spacer element each carry a rotatable bearing which rides on horizontal faces of the wheel-set body slots to prevent the pivot arrangements from binding with the wheel-set bodies during pivotal rotation of the footboards relatively to the support element.

The skateboard may include foot straps which are attached to the foot platforms.

The various features of novelty which characterize the invention are pointed out with particularly in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENTS

Figures 1, 2, 6:
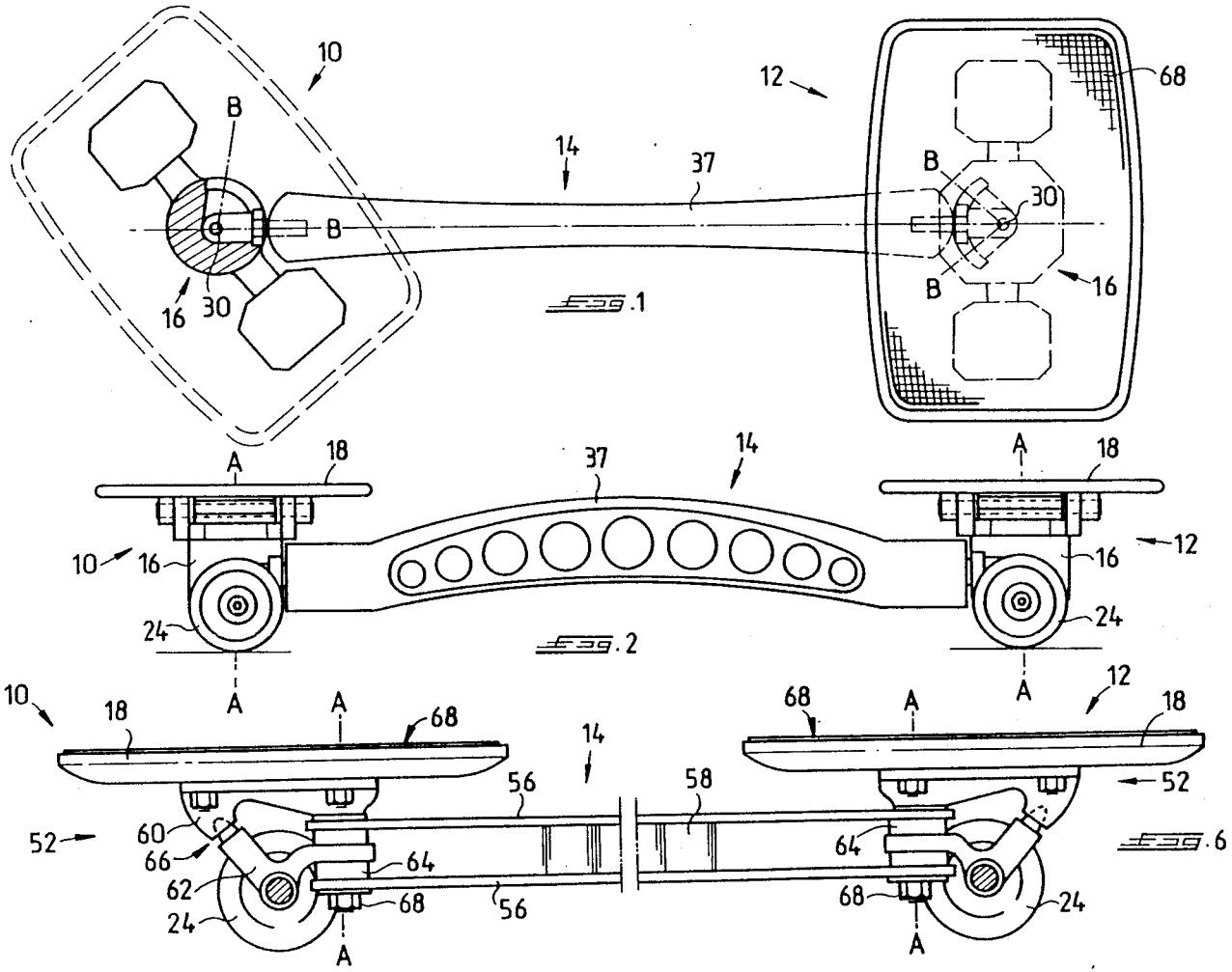
FIG. 1 is a partially sectioned plan view of one embodiment of the skateboard of the invention.
FIG. 2 is a side elevation of the skateboard according to FIG.1.
FIG. 6 is a side elevation of a second embodiment of the board according to the invention.

The skateboard constructed in accordance with the invention shown in the drawings comprise two footboards 10 and 12 and a spacer element 14 which is pivotally connected at each of its ends to a footboard to hold the footboards in the spaced relationship shown in the drawings.

Figure 3:
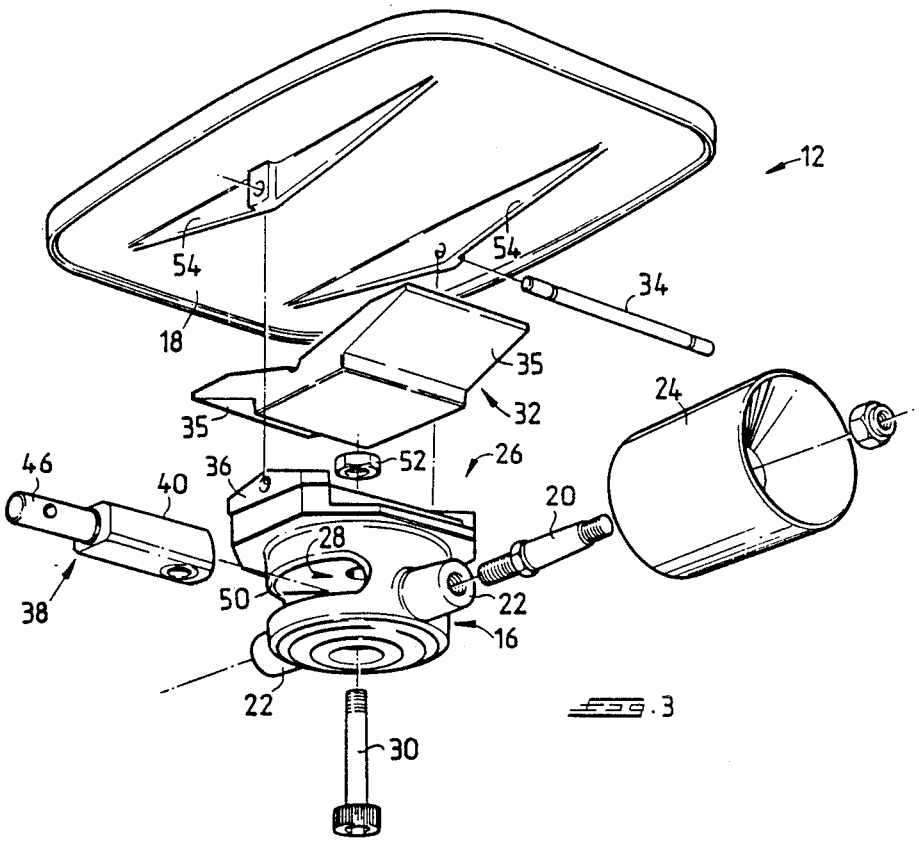
FIG. 3 is an exploded perspective view of one of the footboards of the skatboard of according to FIGS. 1 and 2.
Figure 4:
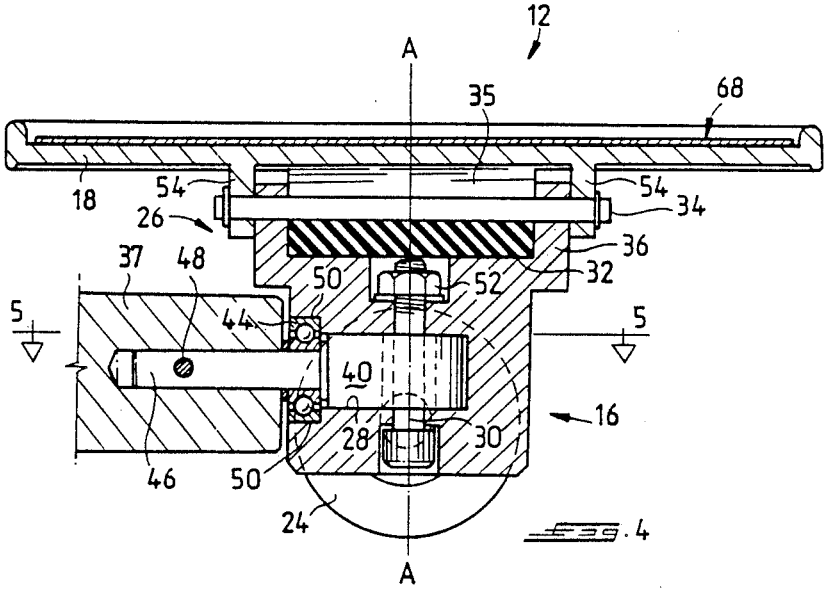
FIG. 4 is a sectioned side elevation of the assembled footboard of according to FIG. 3.

Each of the footboards comprise, as is more clearly seen in FIGS. 3 and 4, of a wheel-set body 16 and a foot platform 18.

Figure 5:
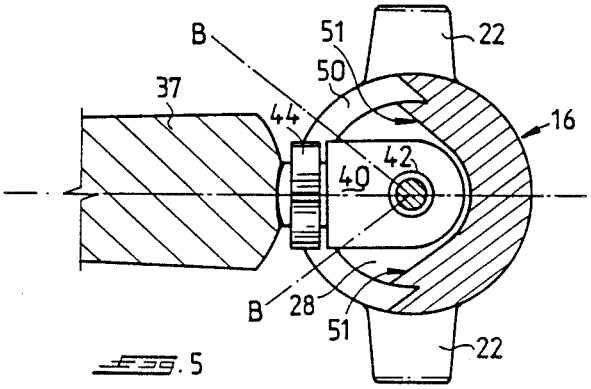
FIG. 5 is a cross sectional plan view taken along the line 5—5 in FIG. 4.

The wheel-set bodies each include two stub axles 20 which are threadedly located in bosses 22 which project from opposite sides of the body, wheels 24 which are made from a fairly hard resilient material and rotatably located on the stub axles 20, an upper support arrangement indicated generally at 26, a sector shaped slot 28 which is more clearly seen in FIGS. 4 and 5, a first pivot pin 30, a resilient suspension pad 32 and a second pivot pin 34 for pivotally holding the foot platform 18 to the support arrangement 26.

The suspension pad 32 is made from a hard rubber or suitable plastic and, as shown in FIG. 3, includes a rectangular base portion and two upwardly and outwardly directed wings 35. The upper surface of the pad is grooved between the wings to locate the pad on the pivot pin 34 in use.

The support arrangement 26 includes two upwardly directed gabled lugs 36 which are holed to receive the pivot pin 34 and a rectagular recess, in which the base of the suspension pad 32 is located in use.

The spacer element 14 consists of an elongated frame member 37 which carries a pivot arm 38 on each of its ends. The frame member is made from any suitably rigid and robust material such as reinforced plastic, aluminum or the like. The pivot arms 38 each consist of a pivot lug 40 which carries a suitable bush 42, a roller bearing 44 and a spigot 46 which is a press fit in a bore in the end of the frame member 37. A locking pin 48 passes through the spigot 46 and the frame member to hold the pivot arm against rotation and withdrawal from the bore in which it is located.

The slots 28 in the wheel-set body 16 are each outwardly stepped at 50 to a dimension at which the roller bearing 44 on the pivot arm is fit as shown in FIG. 4.

To assemble the skateboard the pivot arm lugs 40 are located in the slots 28 in the wheel-set bodies, the pivot pins 30 are passed from the underside of the bodies through the bush in the lugs 40 and are locked to the bodies by lock nuts 52 which are located in recesses in the bases of the suspension pad recesses in the support arrangement 26.

The suspension pad 32 is now located in the recess in the upper surface of the support arrangement 26 and the foot platforms are pressed heavily down on to the wings 35 of the suspension pad resiliently to deform the wings downwardly against the bias of the pad material until holes in lugs 54 on the undersides of the foot platforms are in register with the holes in the support arrangement gable lugs 36. The pivot pin 34 in now pressed through the registering holes in the gable lugs 36 and lugs 54 on the foot platform and locked in position by means of circlips as shown in FIG. 4. The pivot pin is now firmly located in the central groove on the upper surface of the suspension pad firmly to locate the suspension pad in the wheel-set. The upward bias of the suspension pad wings 35 on the underside of the foot platform holds the platform horizontal while allowing a limited resilient pivotal movement of the platform about the pivot axis of the pin 34.

From the above it will be appreciated that the foot platforms 10 and 12 are rotatable about the axes A of the pivot pins 30 within angular limits imposed on them by vertical edges 51 of the slots 28 in the wheel-set bodies 16. This is illustrated in FIGS. 1 and 5 in which the phantom lines B illustrate the limit positions of the angle or rotation of the support element relatively to the footboards at which the vertical side edges of the slots 28 come into contact with the sides of the pivot arm lugs 40 at the limit positions of rotation of the footboards the wheels 24 are just out of breaking contact with the spacer element 37 as illustrated on the left hand side of FIG. 1.

The skateboard of FIG. 6, as with the skateboard of the previous embodiment, includes two footboards 10 and 12 and a spacer element 14. In this embodiemnt of the invention, however, the foot platforms 18 are supported on substantially conventional skateboard wheel-sets 52.

The spacer element 14 of this embodiemnt of the invention consist of two strap members 56 made advantageously of metal, and a spacer 58 which is sandwiched between and fixed to the straps to keep them spaced apart vertically.

The wheel-set 52 each consist of separate upper and lower portions 60 and 62 and an annular rubber or like resilient torsion member 64. The lower portion 62 of each wheel set includes a ring portion which tightly surrounds the torsion member 64 with a ball and socket arrangement 66 connecting the outer ends of the wheel set components. A pivot bolt 68 passes through the spacer strap elements 56 and the bore of the torsion member 64 to be threadedly anchored in the wheel set portion 60. The footboards, in this embodiment of the invention, are therefore pivotable relatively to the spacer element on the axes A.

The lower portion 62 of the wheel-sets enable the foot platforms 18 resiliently to pivot in a direction transverse to the spacer element 14 by the torsion members being 64 able resiliently to deform and so tilt within the rings of the lower portion 62 of the wheel-sets while the tilting motion of the platforms is supported by the ball and socket joints 66 on the outer ends of the wheel-sets.

The footboards 18 of the skateboards of the invention advantatageously include footstraps 80 which are fixed to the platforms to pass over the upper surfaces of the boards in a direction transversed to the wheel axes. The upper surfaces of each of the footboards preferably carries a non-skid surface material 90.

In use a skater stands astride the board with his feet on the foot platforms with his foot direction lying in the direction of the wheel axes of the wheel sets and the board is used in much the same manner as a conventional skateboard. However, the maneuverability of the board is obviously much greater than is the case with a conventional board with two fixed wheel-sets or a board in which only one wheel set is steerable. For example, looking at FIG. 1, and assuming the footboard 12 to be non steerably fixed to the spacer element 14 the radius of turn of the board will be determined by the angular displacement of the wheel axis from the long axis of the spacer element with the board being capable of following only the wheel track of the footboard 10. If the footboard 12 is now made to pivot a clocwise direction from the FIG. 1 position, the turning radius of the board is significantly decreased enabling the skater to perform maneuver 5 which are totally impossible with both wheel-sets fixed to the underside of the board or even with one of them steerable. Another significant advantage which the board of the invention has over conventional boards or boards which have a single steerable wheel-set is that by pivotable movement of both of the footboards and suitable weight distribution the board can be caused to follow a sharp sinusoidal track enabling the board to be propelled at fairly high speed over flat or even upwardly inclined surface.

The skateboard is steered or turned by the rider of the board splaying his feet to rotate the boards 10 (10') and 12 (12') about their pivot axis A (A') so that the wheels follow a common curve track with the center of the curve being the crossing point of lines in the register with the axis of the wheels on each footboard. The radius of the curve is determined by the degree of splay of the footboards.

The high performance skateboard includes a resilient suspension means which may, however, also be turned by the rider holding his feet parallel on the footboards 10 (10') and 12 (12') and shifting his weight above the board to tilt the board as is the case with a conventional high performance skateboard with non-turnable wheels.

The optimum turning method of the board of the invention is, however, a combination of both the turning of the footboards about their vertical pivot axis A (A') and by a simultaneous weight shift above the board to tilt the footboards against the bias of the resilient suspension means.

In practice, in very sharp turns at speed, with the board of the invention the rider advantageously leans forwardly or backwardly by as much as 45° towards the inside of the turn with the boards tilted to their maximum extent to resist the centrifical force generated in the turn. His feet and so the footboards are advantageously either inwardly or outwardly splayed depending on whether he's leaning forwardly or backwardly so that the wheel axis point to the center.

While a specific embodiment of the invention has been shown and described in detail to illustrate the application of the principles of the invention, it will be understood that the invention may be embodied otherwise without departing from such principles.

We claim:

1. A skateboard comprising two footboards, each of the footboards including a foot platform and wheel-set which carries two wheels in axial alignment fixed to the underside of the platform, a spacer element for holding the footboards in a spaced relationship and a pivot arrangement having a vertical pivot axis connecting each footboard to the spacer element to enable both footboards to pivot about said vertical pivot axis relatively to the spacer element thereby providing movement of said wheels which corresponds to the movement of said footboards.

2. A skateboard as claimed in claim 1 in which each wheel-set includes a resilient suspension member which is located in the wheel-set to enable limited resilient pivotal movement of the platform relative to the wheel-set attached to it in a direction transverse to the direction of the axis of rotation of the wheels of the wheel-set.

3. A skateboard comprising two footboards each of the footboards including a foot platform and wheel-set which carries two wheels in axial alignment fixed to the underside of the platform, a spacer element for holding the footboards in a spaced relationship and a pivot arrangement having a vertical pivot axis connecting each footboard to the spacer element to enable both footboards to pivot relatively to the spacer element, each wheel set including a wheel body, wheel axles which are fixed to and project from the opposite sides of the body with the wheels being journalled for rotation on the axles, a first pivot pin being attached to the wheel body with its axis in a vertical direction, a support member on the wheel body, a second pivot pin pivotally connecting the foot platform to the support member with its pivot axis normal to the wheel axis, and resilient suspension means between the support member and the underside of the foot platform for holding the platform horizontal, said pivot arrangement being pivotally engaged with the first pivot pin.

4. A skateboard as claimed in claim 3 in which the wheel body and the support member of each wheel-set are integral to provide a wheel-set body with the support member pivot arrangements being engaged with the first pivot pins of each wheel-set through slots in the wheel-set bodies.

5. A skateboard as claimed in claim 4 in which the slots in the wheel set bodies have radially displaced vertical edges to stop rotation of the spacer element pivot arrangements on the first pivot pins to prevent the wheels from coming into contact with the spacer element.

6. A skateboard as claimed in claim 4 in which the pivot arrangements on the spacer element each carry a rotatable bearing which rides on horizontal faces of the wheel set body slots to prevent the pivot arms from binding with the wheel set bodies during pivotal rotation of the footboards relatively to the support element.

7. A skateboard as claimed in claim 3 including foot straps which are attached to the foot platforms.

8. A skateboard comprising: a spacer element, two footboards, a wheel-set connected to each of said footboard, two wheels in axial alignment connected to each of said wheel-sets, each of said wheel-sets being rigidly connected to said footboards with respect to a vertical axis said wheel sets being pivotally connected to said spacer element and being pivotal about a vertical axis.

9. A skateboard according to claim 8, further comprising a resilient suspension means wherein each of said footboards is resiliently set off from said wheels allowing limited resilient pivotal movement of said footboards in a direction transverse to an axis of rotation of the wheels of said rolling means.

10. A skateboard comprising: a spacer element, two footboards, a wheel-set connected to each of said footboards, two wheels in axial alignment connected to each of said wheel-sets, each of said wheel-sets being pivotally connected to said spacer element and being pivotal about a vertical axis, a resilient suspension means wherein each of said footboards is resiliently set off from said wheels allowing limited resilient pivotal movement of said footboards in a direction transverse to an axis of rotation of the wheels of said rolling means, wherein each wheel/set including a wheel body having a slot opening into the interior of said wheel body, two wheel axles being fixed to and projecting from opposite sides of said wheel body, said wheels being journalled for rotation on said axles, a vertical pivot pin contained in said wheel body being concentric with said vertical pivot axis, a pivot arm being connected to said spacer element, said pivot arm having an end projection outwardly from said spacer toward and through said wheel body slot, said pivot arm end having a vertical hole therethrough for receiving said vertical pivot pin and enabling said wheel body and said footboard to pivot about said vertical axis.

11. A skateboard according to claim 10, wherein said wheel body includes a substantially horizontal support member on the top of said wheel body, said resilient suspension means including a suspension pad having a rectangular base portion and two upwardly and outwardly extending wings projecting from said rectangular base portion, said rectangular base portion resting on said support member.

12. A skateboard according to claim 11, wherein said foot platforms include two downwardly extending lug members each having a hole therethrough, said wheel body includes two upwardly extending gabled lugs, each of said gabled lugs having a hole therethrough, a horizontal pivot pin extending through each of said lug member holes and said gabled lug holes allowing said foot platform to pivot relative to said wheel body.

13. A skateboard according to claim 12, wherein said resilient suspension member base portion has a slot for receiving said horizontal pivot pin.

14. A skateboard according to claim 10, wherein said wheel-set slot has vertical walls, said vertical walls making abutting contact with said pivot arm preventing said wheels from coming into contact with said spacer element.

15. A skateboard comprising:

two footboards, each of said footboards having a wheel-set having two wheels in axial alignment, each of said footboards having a foot platform;

a spacer element, each of said wheel-sets being pivotally connected to said spacer element allowing said wheel-sets to pivot about a vertical axis relative to said spacer element upon corresponding movement of said foot platform about the vertical axis, each of said foot platforms being resiliently and pivotally connected to said wheels allowing said foot platforms to pivot about a horizontal axis relative to said wheels.

* * * * *